US010683752B2

(12) United States Patent
Sollami

(10) Patent No.: US 10,683,752 B2
(45) **Date of Patent: *Jun. 16, 2020**

(54) BIT HOLDER SHANK AND DIFFERENTIAL INTERFERENCE BETWEEN THE SHANK DISTAL PORTION AND THE BIT HOLDER BLOCK BORE

(71) Applicant: The Sollami Company, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/708,292

(22) Filed: Sep. 19, 2017

(65) Prior Publication Data

US 2018/0003050 A1 Jan. 4, 2018

Related U.S. Application Data

(63) Continuation of application No. 14/628,482, filed on Feb. 23, 2015, now Pat. No. 9,879,531.

(60) Provisional application No. 61/944,676, filed on Feb. 26, 2014.

(51) Int. Cl.

| | |
|---|---|
| ***E21C 35/18*** | (2006.01) |
| ***E21C 35/197*** | (2006.01) |
| ***E21C 35/19*** | (2006.01) |

(52) U.S. Cl.

CPC ..... *E21C 35/18* (2013.01); *E21C 35/19* (2013.01); *E21C 35/197* (2013.01); *E21C 2035/1826* (2013.01)

(58) Field of Classification Search

CPC ..... E21C 35/18; E21C 35/19

See application file for complete search history.

(56) References Cited

U.S. PATENT DOCUMENTS

| | | | |
|---|---|---|---|
| 2,382,947 | A | 7/1944 | Brozek |
| 3,342,532 | A | 9/1967 | Krekeler |
| 3,397,012 | A | 8/1968 | Krekeler |
| 3,476,438 | A | 11/1969 | Bower, Jr. |
| 3,519,309 | A | 7/1970 | Engle |
| 3,833,264 | A | 9/1974 | Elders |
| 3,833,265 | A | 9/1974 | Elders |
| 3,865,437 | A | 2/1975 | Crosby |
| 4,084,856 | A | 4/1978 | Emmerich |
| 4,247,150 | A | 1/1981 | Wrulich et al. |
| RE30,807 | E | 12/1981 | Elders |
| 4,310,939 | A | 1/1982 | Iijima |
| 4,453,775 | A | 6/1984 | Clemmow |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — Janine M Kreck

(74) *Attorney, Agent, or Firm* — Mercedes V. O'Connor; Rockman Videbeck & O'Connor

(57) ABSTRACT

Improved bit holder/bit holder block structure provides increased access to the rear of the assembly allowing bit holder blocks to be mounted closer to each other for micro-milling operations. Shortened bit holder shanks are reconfigured from prior art to provide increased holding power between the bit holder shank and bit holder block bore.

2 Claims, 5 Drawing Sheets

(56) References Cited

U.S. PATENT DOCUMENTS 4,478,298 A 10/1984 Hake
4,489,986 A 12/1984 Dziak
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,694,918 A 9/1987 Hall
4,702,525 A 10/1987 Sollami
4,763,956 A 8/1988 Emmerich
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 * 4/2002 Sollami ..... B28D 1/188 299/104
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 * 2/2004 Sollami ..... B28D 1/188 299/102
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall
8,007,049 B2 8/2011 Fader et al.
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 * 6/2012 Hall ..... E21C 35/183 299/102
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.

(56) References Cited

U.S. PATENT DOCUMENTS

| | | | |
|---|---|---|---|
| 9,028,008 | B1 | 5/2015 | Bookhamer |
| 9,039,099 | B2 | 5/2015 | Sollami |
| 9,316,061 | B2 | 4/2016 | Hall |
| 9,518,464 | B2 | 12/2016 | Sollami |
| 9,879,531 | B2 | 1/2018 | Sollami |
| 9,909,416 | B1 | 3/2018 | Sollami |
| 9,976,418 | B2 | 5/2018 | Sollami |
| 9,988,903 | B2 | 6/2018 | Sollami |
| 10,072,501 | B2 | 9/2018 | Sollami |
| 10,105,870 | B1 | 10/2018 | Sollami |
| 10,107,097 | B1 | 10/2018 | Sollami |
| 10,107,098 | B2 | 10/2018 | Sollami |
| 10,180,065 | B1 | 1/2019 | Sollami |
| 10,260,342 | B1 | 4/2019 | Sollami |
| 10,323,515 | B1 | 6/2019 | Sollami |
| 10,337,324 | B2 | 7/2019 | Sollami |
| 10,370,966 | B1 | 8/2019 | Sollami |
| 10,385,689 | B1 | 8/2019 | Sollami |
| 10,415,386 | B1 | 9/2019 | Sollami |
| 10,502,056 | B2 | 12/2019 | Sollami |
| 2002/0074850 | A1 | 6/2002 | Montgomery, Jr. |
| 2002/0074851 | A1* | 6/2002 | Montgomery, Jr. .. E21C 35/197 299/107 |
| 2002/0109395 | A1 | 8/2002 | Sollami |
| 2002/0167216 | A1 | 11/2002 | Sollami |
| 2002/0192025 | A1 | 12/2002 | Johnson |
| 2003/0015907 | A1 | 1/2003 | Sollami |
| 2003/0047985 | A1 | 3/2003 | Stiffler |
| 2003/0052530 | A1 | 3/2003 | Sollami |
| 2003/0122414 | A1 | 7/2003 | Sollami |
| 2003/0209366 | A1 | 11/2003 | McAlvain |
| 2004/0004389 | A1 | 1/2004 | Latham |
| 2004/0174065 | A1 | 9/2004 | Sollami |
| 2005/0212345 | A1 | 9/2005 | Sleep et al. |
| 2006/0071538 | A1 | 4/2006 | Sollami |
| 2006/0186724 | A1 | 8/2006 | Stehney |
| 2006/0261663 | A1 | 11/2006 | Sollami |
| 2007/0013224 | A1 | 1/2007 | Stehney |
| 2007/0040442 | A1 | 2/2007 | Weaver |
| 2007/0052279 | A1 | 3/2007 | Sollami |
| 2008/0035386 | A1 | 2/2008 | Hall et al. |
| 2008/0036276 | A1 | 2/2008 | Hall et al. |
| 2008/0036283 | A1 | 2/2008 | Hall et al. |
| 2008/0100124 | A1 | 5/2008 | Hall et al. |
| 2008/0145686 | A1 | 6/2008 | Mirchandani |
| 2008/0164747 | A1 | 7/2008 | Weaver et al. |
| 2008/0284234 | A1 | 11/2008 | Hall et al. |
| 2009/0146491 | A1 | 6/2009 | Fader et al. |
| 2009/0160238 | A1 | 6/2009 | Hall et al. |
| 2009/0256413 | A1 | 10/2009 | Majagi |
| 2009/0261646 | A1 | 10/2009 | Ritchie et al. |
| 2010/0045094 | A1* | 2/2010 | Sollami ..... E21C 35/18 299/102 |
| 2010/0244545 | A1 | 9/2010 | Hall |
| 2010/0253130 | A1 | 10/2010 | Sollami |
| 2010/0320003 | A1 | 12/2010 | Sollami |
| 2010/0320829 | A1 | 12/2010 | Sollami |
| 2011/0006588 | A1 | 1/2011 | Monyak et al. |
| 2011/0089747 | A1 | 4/2011 | Helsel |
| 2011/0175430 | A1 | 7/2011 | Heiderich et al. |
| 2011/0204703 | A1 | 8/2011 | Sollami |
| 2011/0254350 | A1 | 10/2011 | Hall |
| 2012/0001475 | A1 | 1/2012 | Dubay et al. |
| 2012/0027514 | A1 | 2/2012 | Hall |
| 2012/0056465 | A1 | 3/2012 | Gerer et al. |
| 2012/0068527 | A1 | 3/2012 | Erdmann |
| 2012/0104830 | A1 | 5/2012 | Monyak et al. |
| 2012/0181845 | A1 | 7/2012 | Sollami |
| 2012/0242136 | A1 | 9/2012 | Ojanen |
| 2012/0248663 | A1 | 10/2012 | Hall |
| 2012/0261977 | A1 | 10/2012 | Hall |
| 2012/0280559 | A1 | 11/2012 | Watson |
| 2012/0286559 | A1 | 11/2012 | Sollami |
| 2012/0319454 | A1 | 12/2012 | Swope |
| 2013/0169023 | A1* | 7/2013 | Monyak ..... E21C 35/197 299/104 |
| 2013/0181501 | A1 | 7/2013 | Hall et al. |
| 2013/0199693 | A1 | 8/2013 | Tank et al. |
| 2013/0307316 | A1 | 11/2013 | Roetsch et al. |
| 2014/0035346 | A1 | 2/2014 | Fundakowski et al. |
| 2014/0110991 | A1 | 4/2014 | Sollami |
| 2014/0232172 | A1 | 8/2014 | Roth et al. |
| 2014/0262541 | A1 | 9/2014 | Parsana et al. |
| 2014/0326516 | A1 | 11/2014 | Haugvaldstad |
| 2015/0028656 | A1 | 1/2015 | Sollami |
| 2015/0035343 | A1 | 2/2015 | Ojanen |
| 2015/0137579 | A1 | 5/2015 | Lachmann et al. |
| 2015/0198040 | A1 | 7/2015 | Voitic et al. |
| 2015/0240634 | A1 | 8/2015 | Sollami |
| 2015/0285074 | A1 | 10/2015 | Sollami |
| 2015/0292325 | A1 | 10/2015 | Sollami |
| 2015/0300166 | A1 | 10/2015 | Ries et al. |
| 2015/0308488 | A1 | 10/2015 | Kahl |
| 2015/0315910 | A1 | 11/2015 | Sollami |
| 2015/0354285 | A1 | 12/2015 | Hall |
| 2016/0102550 | A1 | 4/2016 | Paros et al. |
| 2016/0194956 | A1 | 7/2016 | Sollami |
| 2016/0229084 | A1 | 8/2016 | Lehnert |
| 2016/0237818 | A1 | 8/2016 | Weber et al. |
| 2017/0089198 | A1 | 3/2017 | Sollami |
| 2017/0101867 | A1 | 4/2017 | Hall et al. |

FOREIGN PATENT DOCUMENTS

| | | |
|---|---|---|
| DE | 202012100353 | 6/2013 |
| DE | 102015121953 | 7/2016 |
| DE | 102016118658 | 3/2017 |
| EP | 3214261 | 9/2017 |
| GB | 1114156 | 5/1968 |
| GB | 2483157 | 2/2012 |
| GB | 2534370 | 7/2016 |
| WO | 2008105915 A2 | 9/2008 |
| WO | 2008105915 A3 | 9/2008 |
| WO | 2009006612 | 1/2009 |

* cited by examiner

BIT HOLDER SHANK AND DIFFERENTIAL INTERFERENCE BETWEEN THE SHANK DISTAL PORTION AND THE BIT HOLDER BLOCK BORE

CROSS-REFERENCE TO RELATED APPLICATION(S)

This application claims priority to U.S. Provisional Application No. 61/944,676, filed Feb. 26, 2014, and claims priority to and is a continuation of U.S. Non-provisional application Ser. No. 14/628,482, filed Feb. 23, 2015, to the extent allowed by law and the contents of which are incorporated herein by reference in their entireties.

TECHNICAL FIELD

This disclosure relates to bit assemblies for road milling, mining and trenching machines and, more particularly, to improved bit holder blocks, bit holders and bits for use in road milling machines.

BACKGROUND

Removing material from the terra firma, whether it be in reconstruction of highways, trenching operations or long wall and other mining operations, has seen numerous improvements in mechanisms to achieve such material removal in recent years. In order to lessen the down time of such material removal machinery, various improvements have been made to bit assemblies, which define the end point at which the machinery separates surface material from the underlayment or ground. This end point where the material removing equipment contacts the surface of the material to be removed is traditionally comprised of a series of bit assemblies that may include bits having a pointed forward end, bit holders in which the bits are mounted or could be made an integral part of, and bit holder blocks in which the base of the bit/bit holder is mounted. The bit holder block is mounted on either an endless chain or chain plate system or a rotatable drum.

Presently, the most common use of this bit assembly is found on the rotatable drum wherein numerous such assemblies are mounted, either in V-shape or spiral form on the drum. Such a recent improvement is found in U.S. Pat. Nos. 6,371,567 and 6,585,326 wherein the bit holder or middle piece of the bit assembly is no longer required to be retained on the bit holder block by a threaded shank with a nut thereon holding the bit holder on the bit holder block. This improvement includes a hollow shank on which the distal end is axially slotted and wherein the shank may be driven into a bore in the bit holder block and the distal end of the shank is compressed radially with a sufficient radial force between the bit holder shank and the bit holder block bore to maintain the bit holder mounted on the bit block during use.

Eliminating a retaining nut or retaining ring from the distal end of the bit holder shank eased the ability to remove the bit holder from the bit holder block through the bottom of the bit holder block. Further, a tungsten carbide tipped bit could be removed from the bit holder by punching same outwardly through the bottom of the bit holder block bore.

Another improvement in bit assemblies has been the introduction of diamond tipped bits or combination bit/holders. The hardened bit tips may be formed of man-made PCD material, or industrial powdered diamond material embedded in a core or base forming a coating on the tip of the bit/holder. With the introduction of this extremely hard material on the tip of the bit cutting assembly, the use of tungsten carbide bits mounted on bit holders which, in turn, are mounted on bit holder blocks has in some instances given way to a unitary combination bit/bit holder which has a longer in use life than the prior tungsten carbide tipped three piece combination. It should also be noted that if desired, a diamond tipped bit may also be utilized in conjunction with already existing bit holders and bit blocks.

In the case of tungsten carbide tipped bits, it may be preferred that the bit have the ability to rotate in the bit holder to spread out the wear characteristics of the bit during use. However, the longer use life of diamond tipped surface removal machinery means that the distal tip no longer has to be rotatable.

Another improvement in the material removing process has been not only the use of regular surface milling equipment which has the spiral mounted bit assemblies customarily positioned at ⅝ inch axially center-to-center in spiral or V-shape fashion across the drum, but also the use of micro-milling equipment wherein the bit tip spacing is 0.200 inch center line to center axial spacing between the bits. Micro milling is used not only to remove materials that regular milling achieves, but also to level parts of bumpy surfaces of roads, or remove just the upper portion of the road surface, perhaps an inch or two, to smooth the road surface, or to allow the delaying of resurfacing, thus achieving additional road surface life and saving money.

The use of many more bit assemblies on a single drum, sometimes utilizing about 900 such bit assemblies on a 46-54 inch diameter drum, means that the bit assemblies are mounted on the drum in much closer orientation to each other, thus minimizing the space between the bottom end of one bit holder block and the tip of an adjacent bit holder block. This decrease in adjacent space between bit blocks means that it is even more difficult than previously known to get access to the bottom of the bit holder block in order to drive out the bit holder, or any combination bit/holder from the bit holder block. A need has arisen for structures that will increase the adjacent distance between the forward end of bit assemblies and the rear of adjacent bit assemblies, thus providing more room for maintenance personnel to replace bits, holders, or combination bit/holders.

SUMMARY

This disclosure relates generally to bit assemblies for road milling, mining, and trenching equipment. One implementation of the teachings herein is a bit holder that includes a front body portion, and a generally cylindrical hollow shank depending axially from said body portion. The shank includes a slot through a side wall thereof extending generally axially from a distal end thereof. An outer surface of the shank adjacent the distal end thereof being of a differing radial orientation from the adjacent bit holder block bore.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figure 1:
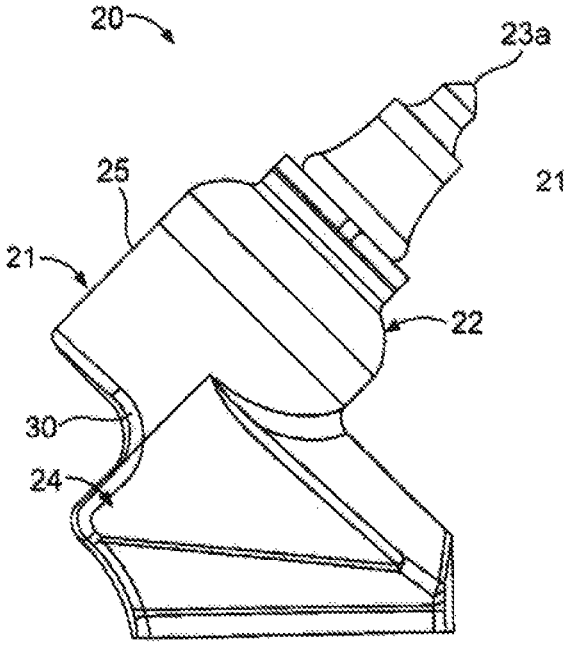
FIG. 1 is a side elevational view of a first embodiment of a bit assembly constructed in accordance with implementations of this disclosure.
Figure 2:
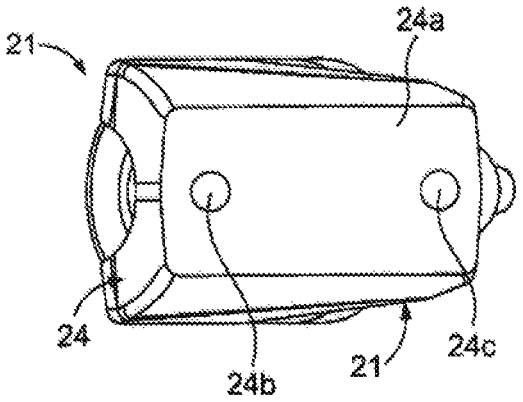
FIG. 2 is a bottom plan view of the bit assembly shown in FIG. 1.

Referring to FIGS. 1-4, 8 and 16, a first embodiment of a complete bit assembly 20 constructed in accordance with the present disclosure, includes a bit holder block 21, a bit holder 22, and a bit 23. A plurality of these assemblies, as mentioned previously, sometimes up to 900, for micro-milling operations, are mounted in V-shape or spiral fashion around the outside of a hollow cylindrical drum (not shown), typically 46-54 inches in diameter. Also, a bottom 24*a* of a base 24 of the bit holder block 21 of the bit assembly 20 may be mounted on an endless chain or chain and plate system or drum (not shown) for trenching or mining operations.

The First Embodiment Bit Assembly

Figure 7:
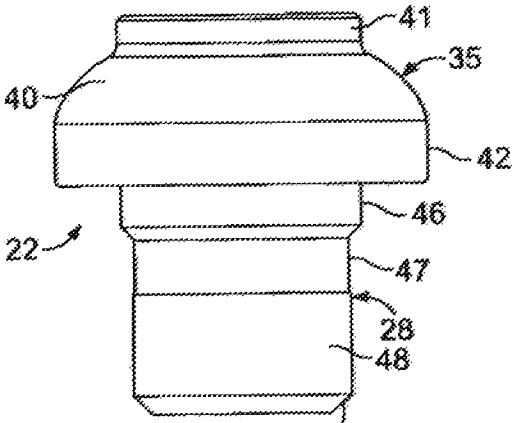
FIG. 7 is a side elevational view of the bit holder shown in FIGS. 5 and 6.

Each bit assembly 20 includes a bit holder block 21 having a base 24 and a bit holder or bit/holder mounting portion 25. In this embodiment, the bit holder mounting portion 25 is generally cylindrical and extends from the base 24 portion as mentioned previously. The bit block 21, constructed in accordance with the present disclosure, includes the axially shortened annular bit holder mounting portion 25 which receives the bit holder 22 or bit/holder (26*a*, 26 FIGS. 8 and 15) in a bit block bore 27 positioned centrally therein. The shortened axial length of the generally annular bit holder receiving portion 25 approximates 1.5 inches in length with a nominal diameter of 1.5 inches (FIG. 7). The ratio of bit holder shank diameter D, bit holder mounting position, to its length L is generally a one to one ratio.

Figure 4:
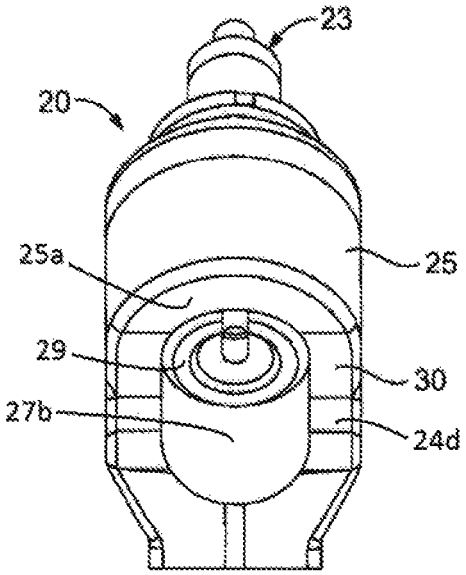
FIG. 4 is a rear elevational view of the bit assembly shown in FIG. 1.
Figure 11:
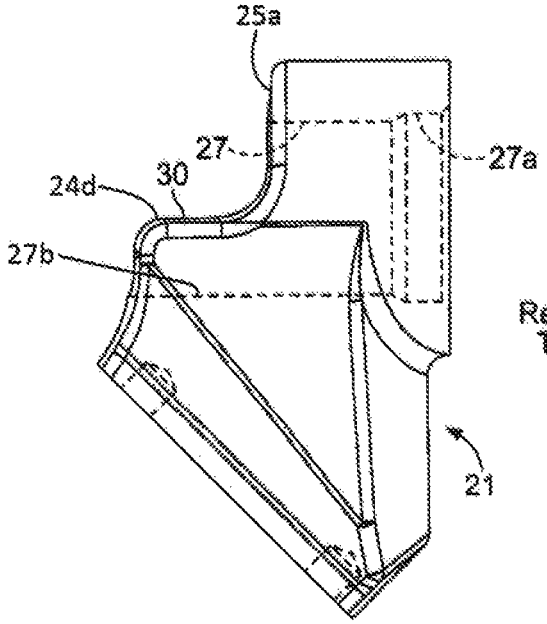
FIG. 11 is a detailed side elevational view of the increased rear access bit holder shown in FIG. 1.

As shown most clearly in FIG. 11, the shortened shank can use an improved structure for either selectably releasing or securing the bit holder to the bit holder block 20. The bit holder block bore 27 includes an enlarged (0.030 inch per side) upper shoulder portion 27*a* approximately ¼-⅜ inch in axial depth. The remainder of the bit block bore 27 may be straight cylindrical or a non-locking taper, preferably one degree per side. The shortened portion of the bit holder block/bit holder receiving portion is shown most clearly in FIGS. 1 and 16 and is about 1-½ inch in length. The shortened bit holder block bore 27 accepts a shortened bit holder shank 28 of the bit holder 22 such as shown in FIGS. 5, 6, 7, 12, 13 and 14. The shortened shank mounting provides a recess 30 that adds access to the base 29 of the bit holder shank 28 and the base of the bit 23, as shown in FIGS. 4 and 16, which provides over an inch of added access space 30 to the back of the hollow bit holder receiving portion 25, thus more adequately allowing a driving rod or other removal tool (not shown) to drive the bit holder 22 outwardly of the bit holder block bore 27 from the bottom thereof.

Figure 5:
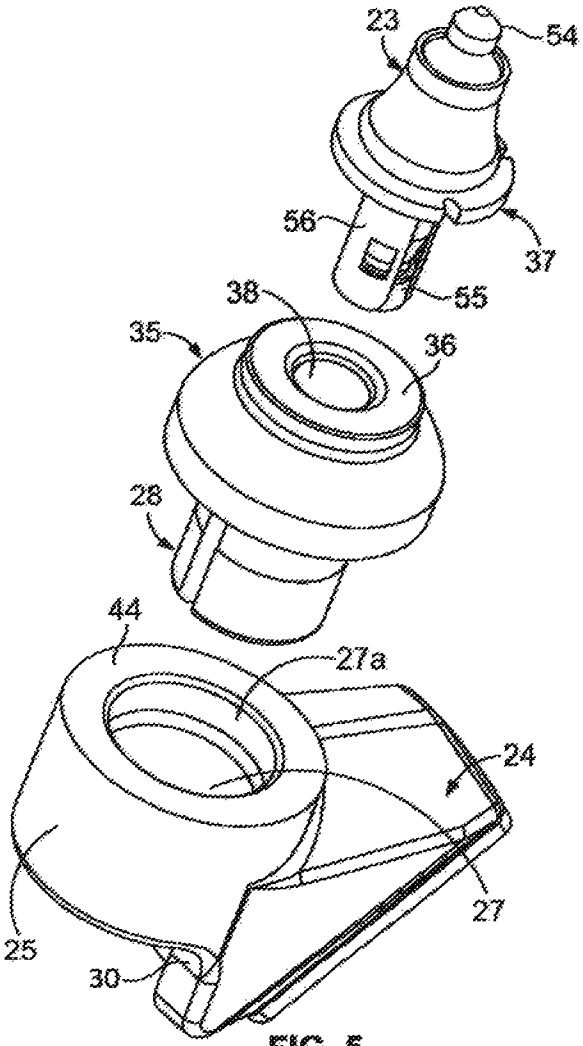
FIG. 5 is an exploded perspective view of the bit assembly shown in FIG. 1.
Figure 14:
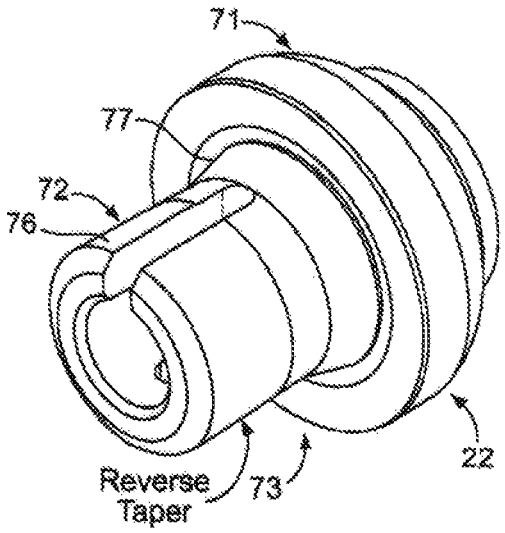
FIG. 14 is a rear ¾ perspective view of a second modification of the first embodiment of the bit holder having a reverse taper similar to FIG. 13, but including a tapered annular upper shank segment above the inner end of the shank slot and yet below the tire portion of the bit holder body.

The bit holder block 21 mounting base 24 is similar to that previously known, in having a generally rectangular bottom 24*a*, which may be slightly curved to fit on the outside of a rotating drum (not shown), with a pair of mounting holes 24*b*, 24*c* therein. The base 24 may slightly widen from its bottom wall 24*a* and eventually forms a pair of triangular sides 31, 32 together with a peaked front portion sloping downwardly and outwardly from an upward ridge 39 thereof to deflect material which is loosened by the tip and body of the bit 23 mounted on the bit holder 22. At the top of the bit holder block, shown most clearly in FIG. 5, is the bit holder base block mounting portion 25 which is generally annular in construction having the bore 27 centrally therethrough, which includes the upper expanded portion 27*a* that may be cylindrical in shape or may have a non-locking taper to fit the bit holder 22 therein such as shown in FIG. 14.

As mentioned previously, the remainder or bottom portion of the bit holder block bore 27 may be cylindrical or have a non-locking taper, presently preferably a one degree per side, conforming to the distal taper of the bit holder shank (or not conforming thereto as will be discussed in more detail below). A side 24*d* of the base 24 includes an extension of an arcuate segment 27*b* of the bit holder block bore 27 that extends outwardly from a rear 25*a* of the bit holder receiving portion 25, as shown in FIGS. 4, 11, 15, and 16.

Figure 16:
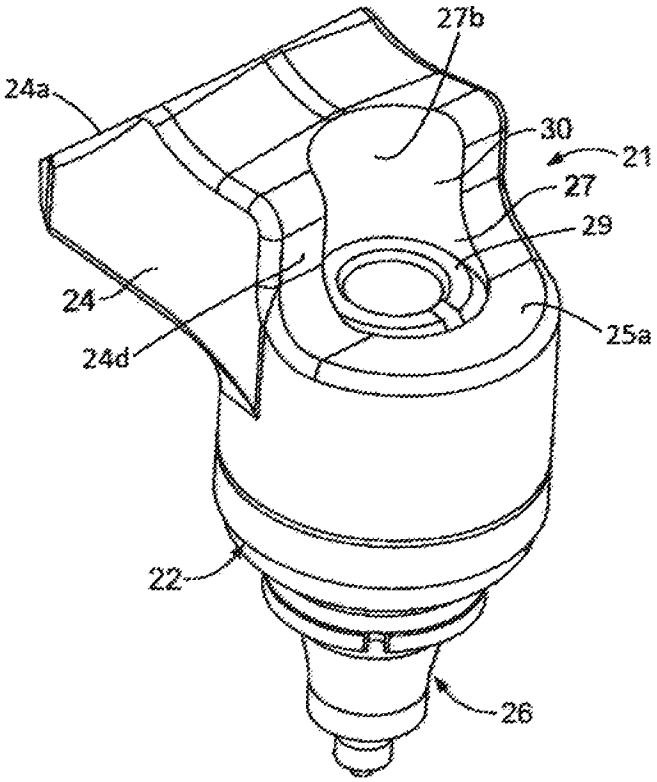
FIG. 16 is a bottom ¾ perspective view of the first embodiment bit assembly shown in FIG. 1 disclosing the added access space adjacent the bottom of the bit holder block.

FIG. 16 shows the first embodiment of the bit assembly 20 as it appears when mounted on a rotating drum (not shown) in an upside down position in which a drive punch (not shown) may be utilized to drive out the bit holder 22 from the bit holder block bore, or in which a smaller drive pin may be utilized to drive out a bit from the bit mounting bore of the bit holder.

Figure 3:
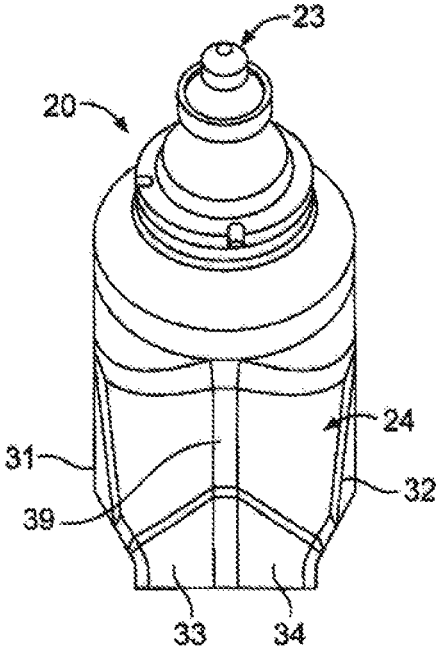
FIG. 3 is a front elevational view of the bit assembly shown in FIG. 1.

The base 24 of the bit holder block 21 and the recess 30 in which the bit holder block bore 27 extends as shown in FIG. 16 is smoothly shaped to conveniently allow the macadam, cement or concrete particles, or terra firma (not shown) that may be logged thereon to be more easily removed therefrom when obtaining access to the base 24 of the bit holder block 21. As shown in FIG. 3, the very front of the bit holder block 21 may be cut off to form a pair of opposed substantially vertical wall portions 33, 34 which provide added space for mounting adjacent bit blocks on a drum, or an endless chain. Thus, a plurality of bit holder blocks 21 may be mounted in closer proximity to one another, especially for use in micro milling operations wherein adjacent bit assembly bit tips 23*a* are mounted at a 0.200 inch axial spacing, rather than the more conventional 0.625 inch axial spacing found in regular bit assemblies mounted on drums for road milling purposes. The width and length of the bit holder block is important in achieving 0.200 inch spacing.

Details of the Bit Holder

Figure 6:
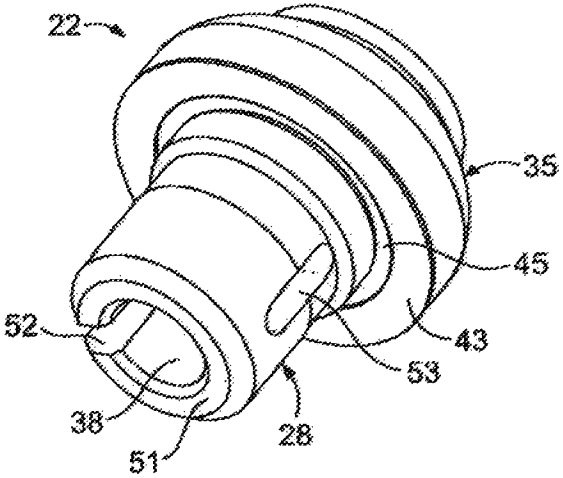
FIG. 6 is a rear ¾ perspective view of the bit holder shown in FIG. 5.

In addition to the figures previously mentioned, FIGS. 5, 6 and 7 disclose detailed views of a bit holder 22 of the first embodiment shown in assembly form in FIGS. 1-4 and 16. The bit holder 22 includes a top body portion 35 and a bottom shank portion 28 (both substantially annular). The top or body portion 35 of the bit holder 22 includes a flat upper annular face 36 with a generally cylindrical outline that is typically identical to or very similar to the major diameter of the bit 23, or bit washer 37, which may be mounted on that upper face 36 and in a central bit bore 38 in the bit holder 22 extending axially through the bit holder body portion 35 and shank 28.

A central portion 40 of the bit holder body portion 35 extends outwardly from a generally cylindrical upper bit mounting portion 41 in this embodiment in a convex shape, although it may be convex, conical or concave, but is generally shaped to deflect material outwardly thereof as it is separated by the bit tip 23*a* and moves axially and outwardly along the bit 23, bit holder 22 and bit holder block 21 bodies.

As the central portion 40 of the first embodiment of the bit holder 22 widens out, it terminates at the juncture between the central portion and the base 42, or what is termed "the tire portion" of the bit holder 22, which is a cylindrical segment approximately ½ inch in axial height and nominally 2-⅝ inch in diameter. The tire portion 42 terminates in an annular radially extending flange 43 forming the bottom portion of the body of the bit holder. This bottom portion is adapted to fit contiguously with a top annular surface 44 of the bit holder receiving portion 25 of the bit holder block 21 previously described. The contiguous fit allows for fewer critical surfaces between the two parts than if the tire portion 42 is spatially related to the top surface 44 of the bit holder block 21 as the shank 28 is fully mounted in the bit holder block bore 27. At the interior of the radially extending flange 43 is a U-shaped undercut 45 which meets at its inner end with the shank 28 of the bit holder 22. This U-shaped groove 45 provides a stress relieving portion between the body portion 35 and shank 28 of the bit holder 22, avoiding sharp edges.

Axially extending from the U-shaped groove 45 is the shank 28 of the bit holder. The top portion of the shank 28 immediately adjacent the body is an enlarged portion 46, approximately ¼-⅜ inch in axial length that is fitted in an interference fit with the enlarged top bore portion 27*a* of the bit holder block bore 27 previously discussed. In this first embodiment, this enlarged portion 46 is generally cylindrical in shape. On nominal 1¼-1¾ diameter shanks, the interference fit with the bit holder block bore approximates 0.001 to 0.003 inches. Immediately adjacent axially outwardly of the enlarged top segment 46 of the shank 28 is a narrowed portion 47 about ⅛-⅝ inch in length, which may be tapered or cylindrical in axial dimension. A distal portion 48 of the shank 28, approximately ½ to 1⅝ inch in length is, in this first embodiment, a non-locking taper extending toward the chamfer 50 along with its radially extending bottom flange 51, defining the bottom of the bit holder shank 28.

In this first illustrated embodiment of bit holder 22, the central portion 47 and the distal portion 48 of the shank 28 may include a pair of slots, one slot 52 extending to the outer distal end of the shank and one internal slot 53, both axially oriented, a preferred 180 degrees apart. These slots allow the distal portion 48 of the shank, a nominal 1½ inch in diameter, which may be cylindrical or non-lockingly tapered with an interference dimension approximately 0.005-0.030 inch larger than the adjacent bottom portion of the bit holder block bore 27 (and discussed in more detail below), thus allowing the shank 28 to radially collapse as it comes into interference with the bit holder block bore 27 a greater amount than would be found in published solid body interference tables. The interference may be termed a differential interference with the bit holder block bore as it increases as one moves from the top of distal portion 48 to the bottom thereof. This interference is increased until it creates a radial force of between 5 thousand and 30 thousand pounds radial force which maintains the bit holder 22 in the bit holder block 21 during the rugged use to which the bit assembly 20 is subjected.

Experiment and observation has shown that in previous embodiments of the present disclosure utilizing identical bit holder shank/bit holder block bore tapers most of the interference fit occurs in the upper portion of the slotted tapered part of the shank. The longer the slotted portion in the shank, the lesser the bending force at the distal end of the shank takes place, yielding less holding force toward the distal end of the shank.

By reducing the angle of the tapered distal portion 48 near the end of the shank of the bit holder 22 more force is radially applied near the distal end of the shank to provide greater differential interference between the shank 28 and bit holder block bore 27. Sufficient holding force may be obtained with a shorter shank than heretofore known.

As long as the cylindrical or non-locking tapered portion 48 of the bit holder shank 28 has an increased convergence with the bit holder block bore 27 toward its bottom flange 51, many combinations such as outward tapered shank/cylindrical block bore, cylindrical shank/inward tapered block bore, inward tapered bore/less inward tapered shank, inward tapered bore/outward tapered shank, etc., can be engineered to provide the necessary holding force between the bit holder and bit block bore. Non-locking tapers generally extend from 0.01 degrees to 3.5 degrees per side or up to a 7 degree total on a diameter.

Referring to FIGS. 1, 3, 4 and 5, the bit assembly 20 of this first embodiment concludes with a bit 23 having a body portion with a generally conically brazed carbide distal tip 54 at the upper end thereof, an annular flange at the bottom of the body portion (not shown) and a generally cylindrical shank 55 which, in this first embodiment includes inwardly extending space for mounting a spring steel C-shaped retainer 56 thereon. In use, this type of bit is allowed to rotate in the bit holder bore 38. The bit holder 22 does not normally rotate in the bit holder block bore 27.

A Second Embodiment

Figure 9:
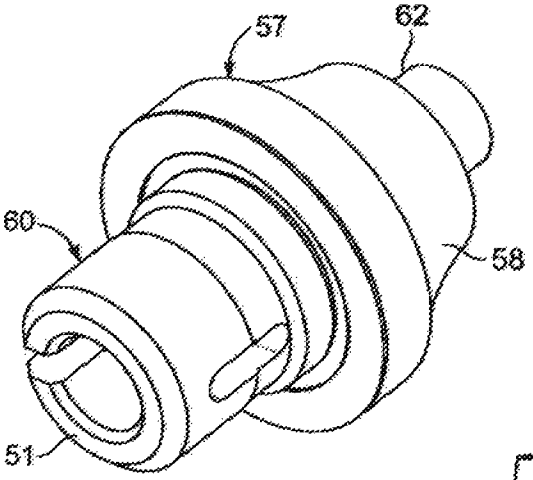
FIG. 9 is a rear ¾ perspective view of the base of the combination bit/holder shown in FIG. 8.
Figure 10:
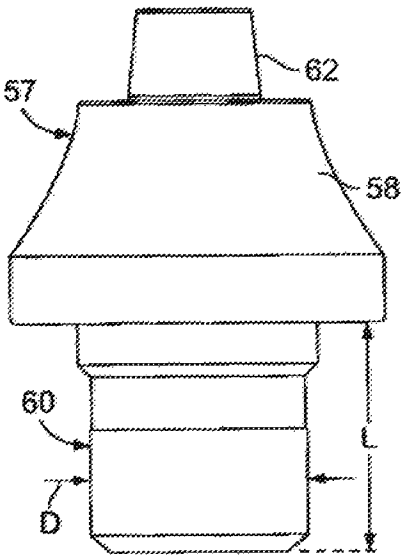
FIG. 10 is a side elevational view of the base for the combination bit/holder shown in FIG. 8.
Figure 8:
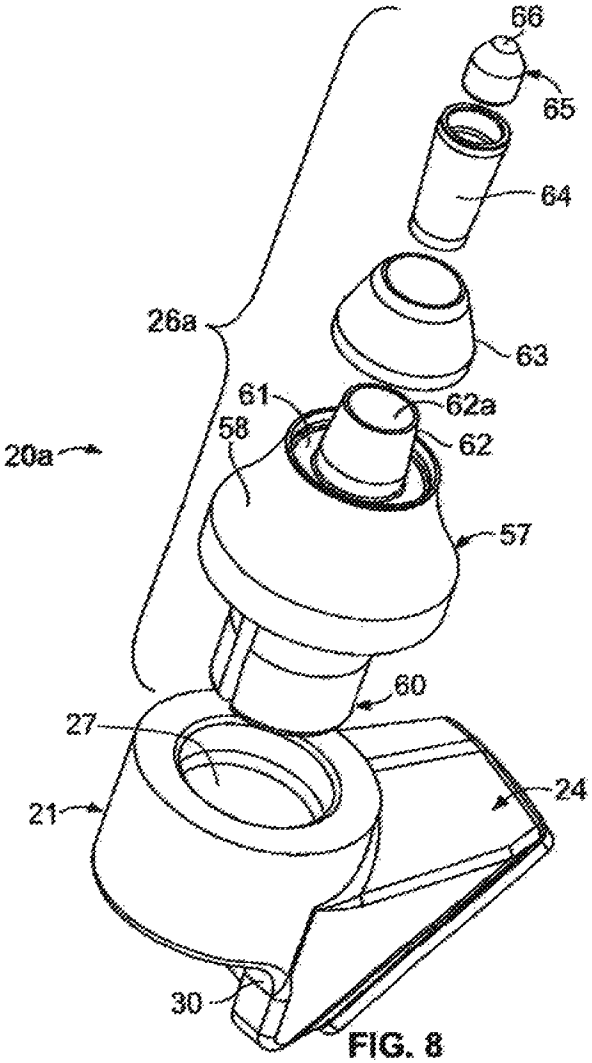
FIG. 8 is an exploded view of a second embodiment of the bit assembly of the present disclosure including a diamond tipped combination bit/holder constructed in accordance with implementations of this disclosure.

Referring to FIGS. 8, 9 and 10, a second embodiment of a bit assembly 20*a* of the present disclosure is shown and described. This second embodiment includes a bit holder block base 24 identical to that shown in the first embodiment. However, it also includes a unitary bit/bit holder 26*a* that has a base 57 with a body portion 58 from the lower part of which a shank 60 axially extends. This body portion 58 and shank 60 are substantially identical to the body portion 35 and shank 28 of the first embodiment of the present disclosure. However, the uppermost face of the central portion of the body 58 includes an annular recess 61 from which a tapered annular distal portion 62 axially extends. The combination of the outer surface of the distal tapered portion 62 and the annular recess 61 provides a base surface for mounting an annular tungsten carbide ring 63 which is a hollow frustoconical shape tapering from its bottom to the top thereof and snugly fitting over the distal annular portion 62 of the body 58. The upper distal annular portion 62 of the body 58 includes a central recess 62*a* into which a tapered member 64 receiving recess is formed. This tapered member 64 slidingly fits and is retained in the distal recess 62*a* of the upper portion 62 of the body or base 58. A diamond coated generally conical distal ended bit tip 66 is mounted in the recess formed in the top of the tapered member 64. All these members are brazed in their respective recesses to form a generally unitary bit/holder 26*a* that fits in the bit holder block bore 27 similarly to the first embodiment of bit assembly 20 of the present disclosure.

The diamond tip 66 at the top of the bit/holder 26*a* has an in-use life substantially greater than a tungsten carbide tip. As such, this unitary member does not have to rotate due to the long useful life that the diamond coated tip 66 provides. The shortened shank 60 of the base 58 of the bit/holder 26*a* fits in the bit holder block bore 27 similarly to the shank of the holder in the first embodiment and is provided with ease of extraction therefrom similarly to the first embodiment.

The structure of the top portion of the bit/holder is generally found in Applicant's U.S. Pat. No. 6,739,327 in which this top portion forms the top portion of a bit which is removable from its respective bit holder.

A Third Embodiment

Figure 12:
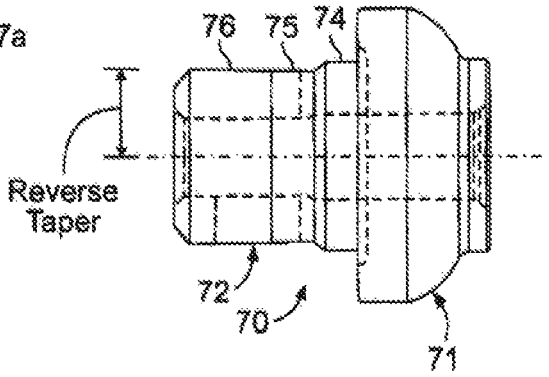
FIG. 12 is a side elevational view of a first modification of the first embodiment of the bit holder shown in FIG. 7 wherein the distal end of the shank includes a reverse taper.
Figure 13:
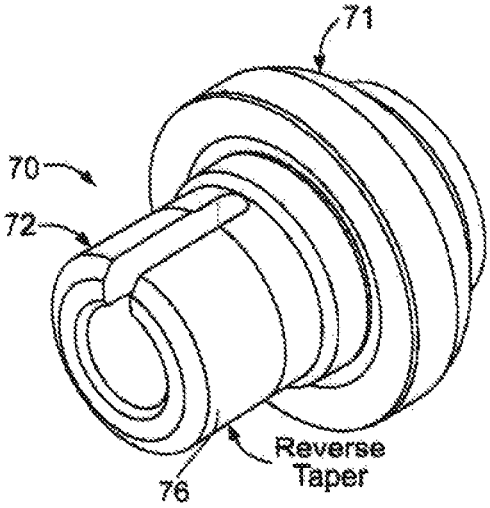
FIG. 13 is a rear ¾ perspective view of the first modification reverse taper bit holder shown in FIG. 12.

Referring to FIGS. 12, 13 and 14, a third embodiment of a bit holder 70 is shown. This third embodiment of bit holder 70 also includes an upper body portion 71 and a lower shank 72 portion. A first modification of a bit holder 73 of the third embodiment is shown in FIG. 14, to be discussed in more detail below. In each, the upper body portion 71 of the bit holder is substantially identical to the upper body portion of the first embodiment bit holder 22, shown in FIGS. 1, 3, 5, 6 and 7. Also, an upper portion 74 and a center portion 75 of the shank 72 of this embodiment is identical to that shown in the first embodiment of bit holder 22, specifically FIGS. 5, 6 and 7 thereof. However, the difference between the first embodiment of bit holder 22 and this third embodiment of bit holder 70 and first modification of bit holder 73 is found in a specific reverse non-locking taper of a distal portion 76 of the shank 72 (as shown in FIGS. 12-14). This non-locking size reverse taper fits in either cylindrical, or the preferred one degree per side regular taper of the bit holder block bore 27 shown most clearly in FIG. 11. The reverse taper provides a substantial differential interference fit between the portion of the distal taper 76 and the bit holder block bore 27 over only a portion of the length of the shank 72 and the bore 27.

Applicant has found that in prior art quick-change bit holder/bit holder block combinations having identical cylindrical or tapered distal and bottom portions, respectively, that there is less radial force applied in the bit holder shank as one approaches the distal end of the shank, and a greater radial force as one approaches the upper termination of the open ended slot. Therefore, a slight difference or reversal of the distal portion of the bit holder shank diameter will tend to equalize the radial forces between the bottom of the bit holder block bore and along the entire length of the distal portion of the shank. Applicant terms this a differential interference to distinguish it from known prior art.

This slight difference (differential interference) in tapers can exist along a spectrum of shapes. In the disclosure, the bottom portion of the shank having a constant taper is about ½ to 1⅝ inch in axial length. In prior art bit holder/bit holder block bore combinations, each part had equal non-locking tapers, preferably 1 degree or less per side. In this third embodiment, the bit holder shank 72 may preferably have a cylindrical 1 degree outward taper to a bit holder block bore 27 having a 1 degree inward taper or cylindrical configuration, respectively. Similarly, the bit holder shank 72 may be cylindrical with a non-locking taper on the bit holder block bore 27. The relative convergence of the tapered/cylindrical surfaces (differential interference) may differ as discussed in the first embodiment.

Of course, if one wants more force applied toward the bottom of the distal portion 76 of the shank 72, then a larger degree of non-locking taper difference is desired. The degree of difference in the tapers is limited only by the limits of non-locking tapers and by the diameter of the shank end and the diameter of the top opening of the bit holder block bore. One needs to be able to center the bit holder shank in the bit holder block bore 27 to drive it into place.

Non-locking tapers are about 3½ degrees per side or 7 degrees total. The present preferred embodiments provide the shortest shank distal portions. As one increases the differing tapers toward the limits of non-locking tapers, the length of the distal or bottom portion of the shank and bit holder block bore must increase to allow the required total holding force to be obtained.

This limited difference (differential interference) in substantial annular contact surface between the distal end of the shank and the bottom of the bit holder block bore provides for greater ease of entry and removal of the bit holder from the bit holder block by only having to move the bit holder a short distance in the bit holder block to obtain release. The size of the non-locking, presently preferred ½ degree per side or greater reverse non-locking taper in the nominal 1½ inch diameter of the shank 72 is sized to fit the bottom portion of the bit holder block bore 27 with an interference that approximately exerts between 5 and 30 thousand pounds of radial force, but over a shorter axial contact surface distance. One or two slots may be used. A single slot exerts more radial force than two slots. The combination of the slotted reverse taper shank 72 and the generally cylindrical upper expanded cylindrical shank portion 74 having a standard 0.001-0.003 interference with the upper expanded portion 27*a* of the bit holder block bore 27 provides for a substantial mounting of this embodiment of the bit holder 70 in the bit holder block bore 27 during use.

FIG. 14 shows the first modification of bit holder 73 of the third embodiment wherein an upper portion 77 of the bit holder shank 72 is tapered rather than cylindrical in shape having a locking or non-locking taper that would fit in a complementarily shaped taper in the upper portion of the bit holder block bore (not shown).

Fourth Embodiment Bit/Holder

Figure 15:
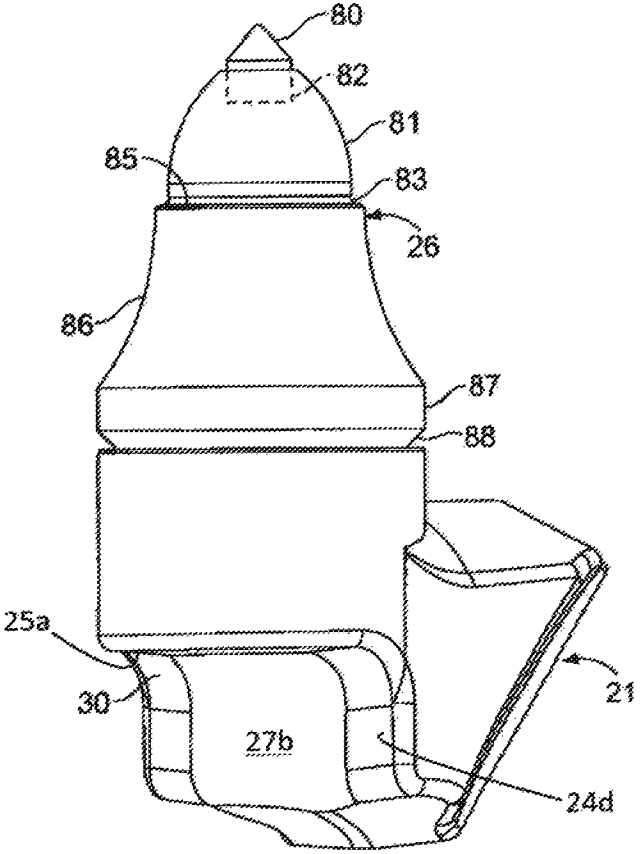
FIG. 15 is a side perspective view of a fourth embodiment combination bit/holder including a diamond tip thereon integrally formed with a holder body as mounted in a bit holder block.

FIG. 15 discloses a fourth embodiment of a bit/holder 26 of the present disclosure providing a combination bit/holder that fits in the improved bit holder block 21 shown in the previous embodiments. The bit/holder 26 includes a generally conical distal ended tip 80 which is either diamond coated or contains a solid diamond tip such that the bit/holder is a unitary structure which fits into the bit holder block bore 27, similarly to the previous embodiments described herein. An upper portion or bolster 81 of the bit/holder aft of the tip includes a tungsten carbide, generally convex shaped member having a recess 82 at the top thereof into which the diamond tip 80 is positioned and brazed. Likewise, an enlarged base 83 of the bolster 81 is brazed onto the top of a body portion 86 of the bit/holder 26.

This body portion 86 includes a recessed counterbore or slightly concave top surface 85, onto which the bolster is brazed, and is an outwardly and axially extending body portion 86 which, in this embodiment, may be concave or convex in surface outline. The lower portion 86 of this central concave portion ends in a generally cylindrical tire or base portion 87 which is similar to the base portions shown in the previous embodiments except that the distal end thereof includes a 45 degree inwardly extending portion 88 that ends in a flat annular face. This 45 degree taper portion 88 provides access for a generally forked tool (not shown) which may be used, as an alternative to the previously mentioned drift pin, to extract the bit/holder from its bit holder block bore. Likewise, in this embodiment, the fourth embodiment bit/holder 26 may be turned upside down similarly to the first embodiment shown in FIG. 16. Thus, with the improvement of the recessed and shortened rear of the bit holder block allowing increased access to the bit/holder shank (not shown), an extraction punch may more easily be used that will force the bit/holder shank axially outwardly of the bit holder block bore 27. Again, in this fourth embodiment, the diamond tip provides a substantially improved bit/holder life such that the bit/holder 26 does not have to rotate, but may be firmly mounted in the bit holder block bore 27 with 5 to 30 thousand pounds of radial force similarly to the prior shown embodiments.

Thus, four embodiments and one modification of bits, bit holders, bit holder blocks and combination bit/holders have been shown and described. It will be apparent to those skilled in the art that many changes and modifications may be made without departing from the true spirit and scope of the present disclosure. It is the intent of the appended claims to cover all such changes and modifications which fall within the true spirit and scope of this disclosure.

While the present disclosure has been described in connection with certain embodiments, it is to be understood that the present disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A bit holder comprising:

a top body portion of increased radius comprising a bottom including an annular groove, a generally cylindrical shank extending axially from the bottom of the top body portion, the shank including a first portion adjacent a distal end of the shank, a second portion adjacent the first portion, and a third portion adjacent the second portion, a first diameter of the first portion and a third diameter of the third portion greater than a second diameter of the second portion, and a constant shape substantially annular surface of the first portion of the shank comprising an angle shaped of a radially outward taper, wherein the constant shape substantially annular surface is adapted to provide an interference fit with a corresponding portion of a bit holder block bore comprising a bore angle differing from the annular surface angle and the interference therebetween increasing toward the distal end of the shank.

2. A bit holder comprising:

a top body portion of increased radius comprising a forward end that includes at least one of a planar surface, a recessed counterbore, and a concave surface, and a bottom including an annular groove, a generally cylindrical shank extending axially from the bottom of the top body portion, the shank including a first portion adjacent a distal end of the shank, a second portion adjacent the first portion, and a third portion adjacent the second portion, a first diameter of the first portion and a third diameter of the third portion greater than a second diameter of the second portion, and a constant shape substantially annular surface of the first portion of the shank comprising an angle shaped of a radially outward taper, wherein the constant shape substantially annular surface is adapted to provide an interference fit with a corresponding portion of a bit holder block bore comprising a bore angle differing from the annular surface angle and the interference therebetween increasing toward the distal end of the shank.

* * * * *